US007083854B1

(12) United States Patent
Joo et al.

(10) Patent No.: US 7,083,854 B1
(45) Date of Patent: Aug. 1, 2006

(54) FIBERS FROM POLYMER NANOCLAY NANOCOMPOSITES BY ELECTROSPINNING

(75) Inventors: Yong Lak Joo, Ithaca, NY (US); Huajun Zhou, Ithaca, NY (US)

(73) Assignee: Cornell Research Foundation, Inc., Ithaca, NY (US)

( * ) Notice: Subject to any disclaimer, the term of this patent is extended or adjusted under 35 U.S.C. 154(b) by 0 days.

(21) Appl. No.: 11/125,242

(22) Filed: May 10, 2005

(51) Int. Cl.
*D01F 6/00* (2006.01)

(52) U.S. Cl. ..... 428/372; 428/364

(58) Field of Classification Search ..... 428/364, 428/372; 264/10, 465, 40.6, 235
See application file for complete search history.

(56) References Cited

U.S. PATENT DOCUMENTS 6,544,644 B1 * 4/2003 Bouquerel et al. ..... 428/364

6,645,569 B1 * 11/2003 Cramer et al. ..... 427/466

OTHER PUBLICATIONS

Powerpoint presentation titled "II. Nanofibers from Nanocomposite Materials" made Nov. 9, 2004 at the American Institute of Chemical Engineers Meeting in Austin, Texas on Nov. 9, 2004.
Printout from Googie on Jun. 26, 2004 headed "Dellite® Nanoclays for Nanocomposites".

* cited by examiner

*Primary Examiner*—N. Edwards
(74) *Attorney, Agent, or Firm*—Bacon & Thomas, PLLC

(57) ABSTRACT

Thermoplastic polymer nanoclay nanocomposite fiber has silicate layers axially aligned through the fiber and enhanced crystallinity and average diameter ranging from 50 nm to 5 μm is produced by solution electrospinning or melt electrospinning where polarity and electric field in the spinning zone are provided so as to potentiate the axial alignment and solidification of polymer is controlled to potentiate increase in crystallinity.

7 Claims, No Drawings

FIBERS FROM POLYMER NANOCLAY NANOCOMPOSITES BY ELECTROSPINNING

TECHNICAL FIELD

The invention is directed to nanocomposite fibers obtained by electrospinning.

BACKGROUND OF THE INVENTION

Prior processes to produce polymer nanoclay nanocomposite fibers provide fibers where axially aligned silicate layers are only at the surface of the fibers, as determined by transmission electron microscopy (TEM). This provides mechanical properties which are less than if such axial alignment were, not only at the fiber surface, but also throughout the entire fiber.

SUMMARY OF THE INVENTION

It has been discovered herein that electrospun polymer nanoclay nanocomposite fibers with axial alignment of silicate layers throughout the fibers and hence significantly increased mechanical properties are produced by selecting polarity and in some cases selecting orientation of electric charge in the spinning zone, to potentiate axial alignment of nanoclay layers and matrix polymer through the fibers and by regulating solidification in the spinning region to increase crystallinity in the fibers, e.g., by regulating temperature in the spinning region and the collector and/or by providing a restrained or moderate rate of evaporation of solvent in the spinning region, to increase crystallinity in the fiber.

In one embodiment, denoted the first embodiment, the invention is directed at thermoplastic polymer nanoclay nanocomposite fiber comprising from 0.5 to 10% by weight nanoclay where silicate layers are axially aligned through the fiber (at the surface of the fiber and inside the fiber) and having a greater degree of crystallinity than where the fiber is obtained without controlled solidification, e.g., by temperature regulation in the spinning zone and fiber collecting zone, said fiber having an average diameter ranging from 50 nm to 5 μm.

In another embodiment of the invention, denoted the second embodiment, the invention is directed to a method of solution electrospinning to produce the fiber of the first embodiment, comprising the steps of:

(a) forming a polymer nanoclay nanocomposite, e.g., containing by weight from 0.5 to 10% nanoclay and 99.5 to 90% polymer by a method comprising melt extruding a dried premix of organically modified nanoclay powder and polymer powder, (b) dissolving 2.5 to 25% by weight of the polymer nanoclay nanocomposite in solvent at room temperature, to form a solution, (c) moving the solution through a zone where the solution is heated via conduction, free convection or radiation, where the moving is effected by a force supplier upstream of or at said zone, (d) then forming droplets from the solution, (e) in a spinning zone, providing an electric charge on the droplets to overcome the surface tension of a droplet to produce a jet of solution and provide unstable flow involving a plurality of electrically induced bending instabilities/whipping motions and evaporation of solvent and elongation of and production of nanocomposite fiber, effecting the electric charge with an electric field and providing reversed voltage polarity between the electric charge on a droplet and a fiber collecting zone to potentiate axial alignment of silicate layers of the nanoclay and of matrix polymer molecules through the fiber, and regulating temperature in the spinning zone and the fiber collecting zone and providing a rate of evaporation of solvent to potentiate increase in crystallinity.

In another embodiment of the invention, denoted the third embodiment, the invention is directed to a method of solution electrospinning to produce the fiber of the first embodiment, comprising the steps of:

(a) forming a homogeneous dispersion of nanoclay particles and solvent (for polymer) and then adding polymer powder or pellets to form a solution containing from 2.5 to 25% by weight of the solution of the total of nanoclay and polymer at 15 to 60° C., e.g., with the nanoclay being present in an amount of 0.5 to 10% by weight of the total of nanoclay and polymer.

(b) moving the solution through a zone where the solution is heated via conduction or irradiation, where the moving is effected by a force supplier upstream of or at said zone, (c) then forming droplets from the solution, (d) in a spinning zone, providing an electric charge on the droplets to overcome the surface tension of a droplet to produce a jet of solution and provide unstable flow involving a plurality of electrically induced bending instabilities/whipping motions and evaporation of solvent and production of nanocomposite fiber, effecting the electric charge with an electric field and providing reversed voltage polarity between the electric charge on a droplet and a fiber collecting zone, to potentiate axial alignment of silicate layers of the nanoclay and of matrix polymer molecules through the fiber, regulating temperature in the spinning zone and in the collecting zone, and providing a rate of evaporation of solvent, to potentiate increase in crystallinity.

In another embodiment of the invention, denoted the fourth embodiment, the invention is directed to a method of melt electrospinning to produce the fiber of the first embodiment, comprising the steps of:

(a) forming a polymer/nanoclay nanocomposite, e.g., containing by weight from 0.5 to 10% be weight nanoclay and 99.5 to 90% by weight polymer, (b) melting the nanocomposite in a melting zone, (c) moving the nanocomposite through the melting zone by a force supplier upstream of or in the melting zone, (d) forming droplets from the melted nanocomposite, (e) in a spinning zone, providing an electric charge on the droplets to overcome the surface tension of a droplet to produce a jet of melted nanocomposite and provide unstable flow involving a plurality of electrically induced bending instabilities/whipping motions and elongation of and production of nanocomposite fiber, effecting the electric charge with an electric field and providing reversed voltage polarity between electric charge on formed droplets and a fiber collecting zone to influence the degree of whipping motion and thus the degree of elongational deformation to potentiate axial alignment of nanoclay layers and matrix polymer molecules through the fiber, and, regulating temperature in the spinning zone and in a collecting zone, to potentiate increase in crystallinity.

As used herein, the term "nanocomposite" means a composition of nanoclay in a polymer matrix, containing, for example, up to 20%, e.g., 0.5 to 10% by weight, nanoclay.

As used herein, the term "nanoclay" means clay having nanometer thickness silicate platelets that can be modified to make clay compatible with organic monomers and polymers, i.e., by cation exchanging nanoclay, e.g., as obtained in the sodium form, with organic cation. The nanoclay can be, for example, montmorillonite (a natural clay) or fluorohectorate or laponite synthetic clays. Other useful nanoclays include, for example, bentonites, beidellites, hectorites, saponites, nontronites, sauconites, vermiculites, ledikites, magadiites, kenyaites and stevensites.

Processes for making polymer/clay nanocomposites are known and have been patented and are under commercial development.

As used herein, the term "powder" means particles of diameter ranging from 10 nm to 1 mm.

As used herein, the term "pellet" means particle of diameter greater than 1 mm.

The number average molecular weight Mn and weight average molecular weight Mw herein are determined by gel permeation chromatography versus polystyrene standards.

The terms "yield stress," "yield strain," and "modulus" as used herein are determined as follows: In a tensile test, the stress is measured with increasing strain (displacement). The yield point corresponds to the point in a stress-strain curve where the material begins to have permanent (unrecoverable) deformation, typically caused by a (slight) decrease in stress with increasing strain. The stress and strain corresponding to the yield point are called the yield stress and yield strain, respectively. The modulus is determined by the slope of the stress-strain curve, i.e., change in stress/change in strain, and for an elastic body is the ratio of the applied stress to change in shape of the elastic body, and has units corresponding to those of the stress, since a dimensionless strain is used to provide the stress-strain curve. Thus increased modulus means increased resistance to change in shape (i.e., more stress to obtain a particular elongation). Increased yield stress means more stress to obtain yield point. Decreased yield strain means less displacement at yield, i.e., decreased flexibility.

The amount of total crystallinity in a fiber is determined by X-Ray Diffraction (XRD) or Differential Scanning Colormetry (DSC). In XRD, the ratio of crystal peaks to total peaks (amorphous plus crystal) represents the degree of crystallinity, whereas in DSC, the relative size of the melting peak to the ideal melting peak gives the crystallinity.

For poly (lactic acid), both Differential Scanning Colormetry (DSC) and X-Ray Diffraction (XRD) can be used to determine the ratio of beta to alpha crystals; in DSC the area of the melting peak for the beta crystal to that of the alpha crystal gives the ratio and in XRD, the area of diffraction peaks for beta to that for alpha is used to calculate the ratio. For nylon 6, the amount of either alpha or gamma crystals can be obtained from peak analysis in XRD or DSC studies.

Beta crystals and alpha crystals for poly (lactic acid) are described in Hoosten, W., et al., Macromolecules 23, 634–642 (1990). The beta crystals have fibrillar morphology; the alpha crystals have lamellar folded chains. The presence of beta crystals indicates more alignment of molecules due to deformation.

Alpha crystals and gamma crystals for nylon 6 are described in Mathias, L. J., et al., Macromolecules, 32, 7958–7960 (1999), and the amount of each can be determined by XRD and DSC.

The axial alignment of silicate layers through the fibers can be determined by transmission electron microscopy (TEM) of axial and radial cross sections of the fiber.

The presence and extent of beta or gamma crystals is a measure of axial alignment of polymer molecules since these crystals only form when polymer molecules are axially aligned.

Either a longitudinally oriented or transversely oriented electric field can be used. However, the presence of a transverse electric field to effect the electric charge is important in the case of systems with low electrical conductivity such as where the polymer is polypropylene. The presence of a transverse electric field to effect the electric charge is not important or required for systems with higher electrical conductivity such as where the polymer is poly (lactic acid) or nylon.

DETAILED DESCRIPTION

We turn now to the thermoplastic polymer nanoclay nanocomposite fiber of the first embodiment.

In some cases, the fiber comprises from 2 to 6% nanoclay and the fiber has an average diameter ranging from 100 nm to 500 nm, e.g., 150 nm to 250 nm.

An exemplification of nanoclay is organically modified montmorillonite, e.g., (bis(2-hydroxy-ethyl)) ammonium montmorillonite (available from Southern Clay Products, Inc. under the tradename Closite 30B).

The thermoplastic polymer is, for example, selected from the group consisting of polyamides, polyesters and polyolefins.

Examples of suitable polyamides are nylon 6 and nylon 6,6. In these cases, the modulus of the fiber is at least 30 MPa and the yield stress of the fiber is at least 15 MPa.

Examples of suitable polyesters are polybutylene terephthalate and aliphatic polyesters such as poly (lactic acid). When the polymer is poly (lactic acid), it has a number average molecular weight ranging from 50,000 to 300,000 and a polydispersity ranging from 1.1 to 4.0 and the thermoplastic polymer nanoclay nanocomposite fiber has a modulus of at least 20 MPa and a yield stress of at least 0.6 MPa and preferably the degree of crystallinity in the poly (lactic acid) is greater than 2.5% and the fraction of beta crystals is greater than 0.40.

For PLA, a cold crystallization temperature between 100 and 130° C. (which is obtained herein) indicates a high degree of molecular alignment.

The fibers of the first embodiment are useful for preparing nonwoven fabric for, for example, filters, protective clothing, biomedical applications, reinforced composites, catalysts and membranes, all with superior mechanical properties (yield stress and modulus).

The fibers of the first embodiment can be prepared by the methods of the second, third and fourth embodiments.

The methods of the second, third and fourth embodiments can be carried out on apparatus as described in Joo et al. U.S. Ser. No. 10/965,813, filed Oct. 18, 2004, minus the step of collecting the fibers to form a non-woven if the product is the fibers in a form other than non-woven fabric. The whole of U.S. Ser. No. 10/965,813 is incorporated herein by reference.

In the second and third embodiments, the zone where the solution is heated can be the chamber 10 depicted in FIG. 1 of U.S. Ser. No. 10/965,813 and the heating is such as to maintain the nanocomposite in solution.

In both the second and third embodiments the polarity and orientation of the electric charge in the spinning zone are controlled to potentiate axial alignment of silicate layers of the nanoclay and a matrix of polymer molecules through the fiber.

Reversing voltage polarity between nozzle forming solution droplets and a collecting zone and effecting the electric charge with a transverse electric field, alters the electric field and surface charge density profiles along the spinline, and thus the degree of whipping. Adjusting the degree of whipping causes modulation of alignment of polymer molecules and nanoclay in the fiber which is being produced.

In both the second and third embodiments, the evaporation of solvent and solidification of the polymer in the spinning zone is controlled by selection of solvent and control of temperature, to potentiate increase in crystallinity. While volatile solvents are preferred in electrospinning to enhance solidification caused by solvent evaporation, too rapid evaporation of solvent prevents crystal formation in the polymer. Hence the proper choice of solvent and regulation of spinning region temperature can potentiate increase in crystallinity. In addition, crystallization caused on evaporation of residual solvent in a collecting zone can be potentiated by regulation of collecting zone temperature. For PLA and nylon 6, temperature in the spinning zone and collecting zone typically range from 10° C. to 60° C.

For the second embodiment, the premix of step (a) is readily prepared by grinding polymer pellets into fine powders with an average size, for example, of 0.5 mm using a mill, combining the polymer powder and nanoclay, e.g., in the form of particles having diameters ranging from 0.1 nm to 2 mm in a mixer, then drying in a vacuum oven. For poly(lactic acid) (PLA), the melt extrusion of step (a) is readily carried out at 220° C. in a nitrogen atmosphere.

In the method of the third embodiment, for step (a), the nanoclay particles, e.g., with diameter ranging from 5 nm to 1000 nm, can be stirred and blended with solvent (for the polymer) until the nanoclay particles are dispersed homogeneously in the solvent, and then pre-dried polymer powders, e.g., with diameters ranging from 0.1 nm to 3 mm, can be added to the nanoclay/solvent suspension.

For PLA, the solvent used in the working examples was chloroform.

For nylon 6, the solvent used in the working examples was hexafluoroisopropanol (HFIP).

We turn now to the fourth embodiment of the invention. The method is readily carried out in apparatus of FIG. 1 or FIG. 2 of U.S. Ser. No. 10/965,813.

For the fourth embodiment, polymer nanocomposites obtained from step (a) of the second embodiment (melt compounded pellets) can be utilized as the polymer/nanoclay nanocomposite for step (a) of the fourth embodiment, and processing can be carried out, e.g., by placing the melt compounded pellet(s) in the syringe of apparatus of FIG. 1 of U.S. Ser. No. 10/965,813 and carrying out melt electrospinning as described in U.S. Ser. No. 10/965,813.

Preferably for producing PLA/nanoclay nanocomposite fibers, the temperature at the collecting zone ranges from 60° C. to 120° C.

Preferably the method of the fourth embodiment additionally comprises at least one of the following steps (f) and (g):

(f) providing a temperature for the nanocomposite being subjected to electrically induced bending instabilities/whipping motions and fiber elongation so as to provide against premature solidification, i.e., solidification before potential amount of crystallization is obtained, due to too rapid cooling, and to provide against induction or relaxation of molecular orientation without affecting the electrically induced being instabilities, (g) shielding to prevent induction voltage in the melting zone.

Very preferably the method of the fourth embodiment comprises the additional step of annealing nanocomposite fiber produced in step (e), for example, in the form of non-woven fabric composed of the fiber, to impart stability and molecular orientation. Annealing conditions for PLA nanocomposite are, for example, annealing temperature ranging from 60° C. to 120° C., preferably an annealing temperature of 120°, and an annealing time ranging from 10 minutes to 3 hours, preferably an annealing time of 3 hours, e.g., annealing conditions of 120° C. for three hours for PLA nanocomposites. The annealing was found to increase alpha and beta crystal structure present for PLA nanocomposites by 10 to 50%.

Reversing voltage polarity between droplet forming nozzle and collector and utilizing a properly oriented electric field in the fourth embodiment influences the degree of whipping motion and thus the degree of elongational deformation to potentiate axial alignment.

The temperature in the spinning zone in the fourth embodiment is regulated to allow solidification but to provide time for crystallization potential to be achieved.

In the second, third, and fourth embodiments, increase in crystallinity enhances mechanical properties (increased modulus and yield stress) of fiber produced.

The invention is illustrated in the following working examples.

EXAMPLE I

Fibers are prepared from poly (lactic acid), Mn equal to about 186,000 and polydispersity of 1.76 and organically modified montmorillonite (Closite B) as described below.

Poly(Lactic) acid pellets which majorly consist of poly (L-lactic) acid (>98%) are supplied by Cargill-Dow. Molecular weight is about 186,000 and polydispersity of 1.76. To prepare PLA nanocomposites, PLA pellets were first ground into fine powders with an average size of 0.5 mm using a Retsch ZM 100 ultra-mill (Glen Mills, Inc.). A polymer/nanoclay premix was prepared by combining appropriate amounts of organically modified montmonrillonite (Closite 30B, Southern Clay Products, Inc.) and polymer powders in a DAC 150FV speed-mixer (Flacktex, Inc.). The premixed powders were then dried in vacuum oven at 80° C. for 12 hours followed by melt-extrusion at 200° C. in a nitrogen atmosphere, with a screw speed of 100 r.p.m. and a residence time of 3 minutes using a bench-top microextruder. Two different compositions of nanocomposites (3 wt % and 5 wt % of nanoclays) are used in the study.

Solutions of PLA/nanoclay composites were prepared in two different ways. The first scheme is to dissolve 10 to 25 wt % of these compounded PLA/nanoclay nanocomposites in chloroform (Sigma-Aldrich). The second method is a simple blending scheme in which nanoclay particles are simply stirred and blended with chloroform until nanoclay particles are dispersed homogeneously in chloroform, and then pre-dried PLA powders are directly added to nanoclay/chloroform suspension. Hence, compounding PLA and nanoclay in a twin screw extruder is by-passed in the second scheme. Solutions made by these two schemes are named as follows; for example, in PLA-NC3, NC denotes the first scheme with twin-screw extrusion compounding and 3 denotes the content of nanoclay in PLA composites. PLA-BL5 represents PLA composites with 5 wt % clay prepared by the second blending scheme.

Electrospinning experiments were conducted in a horizontally placed electrospinning setup. A high voltage source (ES30P, Gamma High Voltage Research, Inc.) was used to apply 10 to 30 kV to a 24 gauged needle on a syringe through copper wiring. A precisely-controlled syringe pump (PHD2000, Harvard Apparatus) was used to continually renew the droplet at the syringe tip. The volumetric flow rate ranged from 0.005 to 0.025 ml/min. Grounded aluminum foil on a metal sheet was placed 6 to 12 inches away from the syringe tip acting as a collector. As the applied voltage is increased, a droplet at the needle tip deforms into a conical shape and then an electrically charged jet is formed. The jet solidifies due to the evaporation of solvent, as it goes through a vigorous whipping motion. As a result, non-woven fiber mats are formed on the surface of the collector.

These fiber fabrics were then characterized by various methods. Thermal analysis was conducted by DSC (Seiko, DSC 220° C.). Approximately 5 mg of samples were loaded and heated in a nitrogen atmosphere at a rate of 10 nC/min until the temperature reached 200° C. Morphology of electrospun fibers was examined by SEM (Leica 440). Structural study was performed through XRD (Scintag, Inc. Theta—Theta Diffractometer) and TEM (JEOL 1200EX). XRD data were collected in the 20 range of 1–40°, in steps of 0.02° and a scanning rate of 4 sec per point. For comparison purposes, casting films were also prepared. First, powdes of PLA or nanocomposite were dissolved in chloroform. After removing solvent in air at room temperature, PLA cast films were put into a vacuum oven for 24 hours. These films were then characterized under the same conditions as electrospun fibers.

Temperatures used in the spinning region ranged from 10° C. to 50° C. A transverse electric field was used of different polarity from conventional, i.e., with reversed polarity between droplets and collecting zone. The amount of nanoclay in relation to polymer was either 3% or 5%. The fibers made by the method of the second embodiment were denoted NC and the fibers made by the method of the third embodiment were denoted BL. Thus PLA-NC3 means fibers of PLA and 3% nanoclay made by the method of the second embodiment and PLA-BL5 means fibers of PLA and 5% nanoclay made by the method of the third embodiment, etc.

A summary of DSC curves for different PLA films/fibers is set forth below.

TABLE 1

| Film/Fiber | $T_g$ | $T^*_c$ | $T^\beta_m$ | $T^\alpha_m$ | $\chi$ (%) | F(β) |
|---|---|---|---|---|---|---|
| Neat PLA Cast Film | N/A | N/A | N/A | 150.6 | 32.4 | 0 |
| PLA-NC3 Cast Film | 52.3 | N/A | N/A | 148.6 | 15.7 | 0 |
| Neat PLA Fibers | 57.8 | 119.2 | 145.3 | 149.3 | 2.2 | 0.27 |
| PLA-BL3 Fibers | 58.6 | 121.4 | 146.3 | 148.7 | 1.8 | 0.23 |
| PLA-NC3 Fibers | 55.1 | 109.9 | 143.8 | 152.9 | 4.4 | 0.59 |
| PLA-BL5 Fibers | 60.5 | 113.5 | 143.4 | 148.9 | 0.8 | 0.20 |
| PLA-NC5 Fibers | 59.9 | 108.9 | 144.2 | 153.2 | 1.4 | 0.59 |

In the above table, $T_g$ means glass transition temperature (° C.), $T^*_c$ means cold crystallization temperature (° C.), $T^\beta_m$ means beta crystal melting temperature (° C.), $T^\alpha_m$ means alpha crystal melting temperature (° C.), $\chi$(%) means degree of crystallinity and F(β) means fraction of β crystal.

Mechanical properties are shown in Table 2 below.

TABLE 2

| | Modulus (MPa) | Yield Strain (%) | Yield Stress (MPa) |
|---|---|---|---|
| Neat PLA Fibers | 18.29 | 27.79 | 0.54 |
| PLA-BL5 Fibers | 17.56 | 24.11 | 0.73 |
| PLA-NC3 Fibers | 36.36 | 19.11 | 1.84 |
| PLA-NC5 Fibers | 39.03 | 18.25 | 1.89 |

As shown in Table 2, modules and yield stress are significantly increased for PLA-NC (100% and 240%, respectively) and yield stress is increased for PLA-BL compared to PLA fibers without nanoclay. (35% increase)

In the case of NC fibers and in the case of BL fibers, the average diameters of fibers are 200–300 nm.

Aligned nanoclay silicate layers were found throughout the fiber including the core. The presence of the nanoclay was determined not to inhibit crystallization and to enhance formation of beta structure.

EXAMPLE II

This is an example of melt electrospinning of PLA nanocomposite. The PLA and nanoclay were the same as for Example I. The apparatus of FIG. 1 of U.S. Ser. No. 10/965,813 was used. Nanocomposite samples (1% clay) (5 gm) were loaded into the syringe and kept in the heating unit for thirty minutes until $T_1$ (as described in Ser. No. 10/965,813) reached 200° C. $T_2$ of Ser. No. 10/965,813 was set between 200° C. and 230° C., $T_3$ of Ser. No. 10/965,813 was set between 40° and 120° C. and $T_4$ of Ser. No. 10/965,813 was between RT and 80° C. Typical flow/rate used was 0.005 ml/min. Fibers contained 3% and 5% nanoclay. Fiber diameters obtained ranged from 500 nm to 900 nm. Aligned nanoclay silicate layers were found throughout the fiber including the core. The fibers obtained were denoted PLA-NC1. Mechanical properties obtained are listed in Table A below. As shown in Table A, modulus and yield stress of melt electrospun PLA-NC1 fibers collected at room temperature (25° C.) are decreased compared to PLA fibers without nanoclay whereas those of PLA-NC1 collected at 60° C. exhibit higher yield stress (40% higher with 1% nanoclay inclusion) than neat PLA fibers collected at the same temperature.

TABLE A

| | Collector Temp., $T_4$ (° C.) | Modulus (MPa) | Yield Strain (%) | Yield Stress (MPa) |
|---|---|---|---|---|
| Neat PLA Fibers | 25 | 13.0 ± 3.0 | 0.34 | 0.38 |
| | 60 | 25.0 ± 4.0 | 0.07 | 0.43 |
| PLA-NC1 Fibers | 25 | 7.7 ± 2.0 | 0.5 | 0.24 |
| | 60 | 27.0 ± 5.0 | 0.07 | 0.72 |

EXAMPLE III

Nylon 6 NC and BL fibers were electrospun from HFIP solution. The procedures were the same as for Example 1.

Modulus and yield stress for nylon 6 BL fibers is increased with increasing nanoclay contents.

The modulus and yield strength for neat nylon 6 fibers, nylon 6-BL3 (3% nanoclay) fibers and nylon 6-NC3 (3% nanoclay) fibers are set forth in Table B below.

TABLE B

| | Modulus MPa | Yield Stress MPa |
|---|---|---|
| Neat Nylon 6 Fibers | 12.8 | 11.2 |
| Nyon 6-BL3 Fibers | 22.9 | 22.7 |
| Nylon 6-NC3 Fibers | 33.3 | 27.5 |

Table B shows both modulus and yield stress of nylon 6-BL3 fibers and nylon 6-NC3 fibers are significantly increased compared to those properties for neat nylon 6 fibers. The nylon 6-BL3 fibers had a 79% increase in modulus and 103% increase in yield stress compared to neat (no nanoclay) nylon 6 fibers, while nylon 6-NC3 fibers had a 160% increase in modulus and 146% increase in yield stress. Aligned silicate layers were found through the NC and BL fibers including in the core.

A decrease in amount of alpha crystals and increase in amount of gamma crystals was associated with increase in axial alignment and mechanical properties.

Temperature ranges in the spinning region and collection setup were found to affect crystallinity. The fibers produced using the setup that induced more alignment had 10% increase in crystallinity and higher mechanical properties.

The nylon 6 fibers had diameters of 200–250 nm.

COMPARATIVE EXAMPLE I

Solvent film casting of PLA and PLA nanocomposites was carried out.

The PLA and the nanoclay were the same as for Example I. Solution made by the method of the second embodiment was denoted NC. Solution made by the method of the third embodiment was denoted BL. The solutions contained 5% nanoclay. Cast films of neat PLA, PLA-BL5 and PLA-NC5 were obtained by evaporating solvent in a hood. Film thicknesses obtained ranges from 0 μm to 10 nm. Randomly oriented nanoclay silicate layers were formed throughout to NC and BL films. Mechanical properties obtained are listed in Table C below.

TABLE C

| | Modulus MPa | Yield Strain % | Yield Stress MPa |
|---|---|---|---|
| Neat PLA Cast Film | 215.8 | 2.34 | 17.4 |
| PLA-BL5 Cast Film | 899.8 | 0.46 | 28.7 |
| PLA-NC5 Cast Film | 420.2 | 1.49 | 22.5 |

As shown in Table C, modulus and yield stress of both PLA-NC5 and PLA-BL5 films were increased compared to PLA film without nanoclay, but increased in yield stress only 30% or 65% due to relatively poor alignment of nanoclay silicate layers. The results indicate that the degree of increase in Example I was unexpected.

COMPARATIVE EXAMPLE 2

Conventional fiber preparation, e.g., by spinning and injection molding gave silicate layer alignment in the skin layer only; this was determined not to enhance mechanical properties.

The foregoing description of the invention has been presented describing certain operable and preferred embodiments. It is not intended that the invention should be so limited since variations and modifications thereof will be obvious to those skilled in the art, all of which are within the spirit and scope of the invention.

What is claimed is:

1. Thermoplastic polymer nanoclay nanocomposite fiber comprising from 0.5 to 10% by weight nanoclay where the silicate layers are axially aligned through the fiber at the surface of the fiber and inside the fiber, said fiber having an average diameter ranging from 50 nm to 5 μm.

2. The fiber of claim 1 where the nanoclay is organically modified montmorillonite.

3. The fiber of claim 2 where the polymer is a polyamide.

4. The fiber of claim 3 where the polymer is nylon 6 or nylon 6,6 and the modulus of the fiber is at least 30 MPa and the yield stress of the fiber is at least 15 MPa.

5. The fiber of claim 2 where the polymer is polyester or polyolefin.

6. The fiber of claim 5 where the polymer is poly (lactic acid) having a number average molecular weight ranging from 50,000 to 300,000 and a polydispersity ranging from 1.1 to 4.0 and having a modulus of at least 20 MPa and a yield stress of at least 0.6 MPa.

7. The fiber of claim 6 where the degree of crystallinity in the poly (lactic acid) is greater than 2.5% and the fraction of beta crystals is greater than 0.40.

* * * * *